US008878062B2

(12) United States Patent
Tanaka et al.

(10) Patent No.: US 8,878,062 B2
(45) Date of Patent: Nov. 4, 2014

(54) CABLE CONNECTION STRUCTURE AND CABLE CONNECTION METHOD

(75) Inventors: Kotaro Tanaka, Naka-gun (JP); Akihiro Yaguchi, Kasama (JP); Hiroshi Oyama, Kawasaki (JP)

(73) Assignee: Hitachi Metals, Ltd., Tokyo (JP)

( * ) Notice: Subject to any disclaimer, the term of this patent is extended or adjusted under 35 U.S.C. 154(b) by 131 days.

(21) Appl. No.: 13/067,410

(22) Filed: May 31, 2011

(65) Prior Publication Data

US 2011/0306235 A1 Dec. 15, 2011

(30) Foreign Application Priority Data

Jun. 10, 2010 (JP) ..... 2010-133118

(51) Int. Cl.
*H01R 9/05* (2006.01)
*H01B 13/20* (2006.01)
*H01R 4/02* (2006.01)

(52) U.S. Cl.
CPC ..... *H01R 9/0515* (2013.01); *H01R 4/027* (2013.01)
USPC ..... 174/71 C; 439/578; 29/828

(58) Field of Classification Search
USPC ..... 174/69, 71 C, 72 C, 72 R, 74 R, 78; 439/578; 29/828
See application file for complete search history.

(56) References Cited

U.S. PATENT DOCUMENTS 5,347,711 A * 9/1994 Wheatcraft et al. ..... 29/843
5,710,393 A * 1/1998 Smith et al. ..... 174/74 R
5,815,916 A * 10/1998 Luc ..... 29/828
7,973,239 B2 * 7/2011 Koyama et al. ..... 174/74 R
2001/0022234 A1 * 9/2001 Okumura et al. ..... 174/78
2004/0080386 A1 * 4/2004 Kitamura et al. ..... 333/246
2004/0185708 A1 * 9/2004 Kuwahara ..... 439/497
2005/0020115 A1 * 1/2005 Edwardsen et al. ..... 439/329
2005/0208828 A1 * 9/2005 Miller et al. ..... 439/581
2006/0185892 A1 * 8/2006 Guengerich et al. ..... 174/260
2008/0236889 A1 * 10/2008 Ishida et al. ..... 174/74 R
2009/0101408 A1 * 4/2009 Koyama et al. ..... 174/72 A
2009/0120662 A1 * 5/2009 Tanaka ..... 174/113 R

FOREIGN PATENT DOCUMENTS

JP 11-509030 A 8/1999
JP 2002-095129 A 3/2002
JP 2004-47414 A 2/2004

(Continued)

OTHER PUBLICATIONS

Japanese Notice including Information Offer Form dated Oct. 29, 2013 with English translation thereof.

(Continued)

*Primary Examiner* — William H Mayo, III
*Assistant Examiner* — Rhadames J Alonzo Miller
(74) *Attorney, Agent, or Firm* — McGinn IP Law Group, PLLC

(57) ABSTRACT

A cable connection structure includes a multi-core coaxial cable connected to a board. The multi-core coaxial cable includes a plurality of parallel-arranged coaxial cables each including a center conductor and an inner insulator, an outer conductor and an outer insulator sequentially formed on an outer periphery of the center conductor. The board includes a signal electrode connected to the center conductor and a ground electrode connected to the outer conductor. The cable connection structure further includes a positioning member lying between the signal electrode and the ground electrode for positioning the center conductor while the inner insulator is attached to the positioning member.

13 Claims, 7 Drawing Sheets

(56) References Cited

FOREIGN PATENT DOCUMENTS

| | | | |
|---|---|---|---|
| JP | 2005-063878 | A | 3/2005 |
| JP | 2006-180627 | A | 7/2006 |
| JP | 2008-251252 | A | 10/2008 |
| WO | WO 2008/082018 | A1 | 7/2008 |

OTHER PUBLICATIONS

Japanese Notification of Reason(s) for Refusal dated Jul. 2, 2013.

* cited by examiner

CABLE CONNECTION STRUCTURE AND CABLE CONNECTION METHOD

The present application is based on Japanese Patent Application No. 2010-133118 filed on Jun. 10, 2010, the entire contents of which are incorporated herein by reference.

BACKGROUND OF THE INVENTION

1. Field of the Invention

This invention relates to a cable connection structure and a cable connection method for connecting a center conductor of a cable to an electrode formed on a printed circuit board etc.

2. Description of the Related Art

In recent years, reduction in size and weight of various terminal devices, such as, e.g., notebook computer or cellular phone, is demanded in the field of electrical and electronic equipment. Those terminal devices have a structure in which, e.g., an upper housing provided with a liquid crystal display is coupled and fixed to a lower housing provided with a controller via a hinge portion which is three-dimensionally movable, and operability and functionality thereof have been enhanced.

Such terminal devices need to transmit and receive an electric signal between the upper and lower housings via the three-dimensionally movable hinge portion. Therefore, plural cable conductors each of which has a center conductor having a substantially circular cross section formed of a twisted wire or a single wire and an insulator coating an outer periphery thereof, as is a three-dimensionally movable cable e.g., a coaxial cable, are arranged passing through the hinge portion.

Generally, for connecting the plural cable conductors to printed circuit boards which are respectively arranged in two housings, the cable conductors are each soldered and connected to plural connection electrodes formed on the printed circuit boards, or the cable conductors are soldered to each of plural electrode terminals of a connector and are connected to a printed circuit board through the connector.

In the meantime, there is a tendency to reduce an outer diameter of a cable conductor or to narrow an arrangement pitch distance of connection electrodes of a printed circuit board or electrode terminals of a connector to be connected to a cable conductor according as the terminal device becomes highly functional, multi-functional and high density in packaging etc. Accordingly, a coaxial cable used is a micro coaxial cable with, e.g., an outer diameter of about 0.2 mm to 0.15 mm, which is very thin. The plural connection electrodes of the printed circuit board or the electrode terminals of the connector to be connected to the micro coaxial cable are used by being arrayed at a pitch of, e.g., 0.25 mm as an electrode array.

Generally, plural micro coaxial cables as described above are arrayed at a predetermined pitch, are sandwiched and laminated with an adhesive tape on both surfaces, and are used in a flat form. When the plural micro coaxial cables are connected to, e.g., plural connection electrodes of a printed circuit board which are arrayed at an extremely narrow pitch, positions of the micro coaxial cables with respect to the connection electrodes are aligned manually by using, e.g., a microscope, etc., since each of the micro coaxial cables is very thin and flexible, and work for connecting the micro coaxial cable to the connection electrode is carried out using a sharp soldering iron having a tip diameter of 0.2 mm, etc.

In the entire work of connecting such a micro coaxial cable, it is extremely difficult especially to align the position of the micro coaxial cable on the connection electrode. Therefore, various methods of connecting a micro coaxial cable have been proposed to facilitate positioning to a board as an object to be connected and connection work of micro coaxial cable.

One example of the methods of connecting a micro coaxial cable is proposed in, e.g., JP-A-2002-95129 (hereinafter referred to as "patent document 1"). In the method of connecting a micro coaxial cable described in the patent document 1, center conductors of plural micro coaxial cables are fitted to plural cable positioning grooves formed on a grooved heat ray transmitting member (hereinafter referred to as "cable positioning jig"), are pressed and fixed to a solder formed on a pad of a board after positioning and alignment, and are solder-connected to the pad by supplying a heat ray via the cable positioning jig.

Another example of the methods of connecting a micro coaxial cable is proposed in, e.g., JP-A 2008-251252 (hereinafter referred to as "patent document 2"). In the method of connecting a micro coaxial cable described in the patent document 2, a wire solder is placed on center conductors of plural micro coaxial cables which are arrayed so as to correspond to plural electrode terminals of a connector, the center conductors are fitted to plural cable positioning grooves formed on a cable positioning member (hereinafter referred to as "cable positioning jig") to position and align with respect to the electrode terminals of the connector, and are solder-connected thereto via the wire solder by pressing and heating using a heater chip.

SUMMARY OF THE INVENTION

However, an arrangement pitch distance of the cable positioning grooves on the cable positioning jig disclosed in patent document 1 tends to be reduced according as the terminal device becomes highly functional, multi-functional and high density in packaging etc. The arrangement pitch distance of up to about 0.2 mm can be made by, e.g., electro-discharge machining, etc. However, the cable positioning jig disclosed in patent document 1 has a problem that it is difficult to form cable positioning grooves which correspond to an extremely narrower pitch.

A micro coaxial cable is very flexible and has a very thin shape. Therefore, there is a problem that a cable is curved when plural cable conductors are fitted to the cable positioning grooves on the cable positioning jig of patent document 1 and are then pressed and fixed, resulting in that the cable conductors are not precisely placed in the cable positioning grooves.

On the other hand, the method of connecting a micro coaxial cable using a cable positioning jig disclosed in patent document 2 has a similar problem to patent document 1 since it requires connection work in which a micro coaxial cable is fitted to a cable positioning groove and is then pressed.

In the method of connecting a micro coaxial cable disclosed in patent document 2, although the micro coaxial cable is bent when pressed by the cable positioning jig, the micro coaxial cable is not always precisely bent in a pushing direction at the time of bending the cable and may be bent while twisting in a twisting direction of a cable conductor. This causes a problem that plural cable conductors are not completely placed in the cable positioning grooves, and for example, a cable conductor enters an adjacent cable positioning groove, which results in that short-circuit with an adjacent cable conductor occurs.

Accordingly, it is an object of the invention to provide a cable connection structure and a cable connection method in which it is possible to suppress misalignment of coaxial cables during a process of connecting electrodes at the stage of aligning a position of a multi-core coaxial cable composed of plural coaxial cables with respect to an electrode of an object to be connected.

(1) According to one embodiment of the invention, a cable connection structure comprises:

a multi-core coaxial cable connected to a board, wherein the multi-core coaxial cable comprises a plurality of parallel-arranged coaxial cables each comprising a center conductor and an inner insulator, an outer conductor and an outer insulator sequentially formed on an outer periphery of the center conductor, and the board comprises a signal electrode connected to the center conductor and a ground electrode connected to the outer conductor; and a positioning member lying between the signal electrode and the ground electrode for positioning the center conductor while the inner insulator is attached to the positioning member.

In the above embodiment (1) of the invention, the following modifications and changes can be made.

(i) The positioning member comprises a nonconductive material having an adhesiveness or tackiness.

(ii) The positioning member comprises a resin applied to the board at an amount that does not seep into the signal electrode or the ground electrode of the board when the resin is attached to the inner insulator.

(iii) The positioning member has a peeling strength of 1 to 50 N/20 mm.

(2) According to another embodiment of the invention, a cable connection method for connecting a multi-core coaxial cable to a board, wherein the multi-core coaxial cable comprises a plurality of parallel-arranged coaxial cables each comprising a center conductor and an inner insulator, an outer conductor and an outer insulator sequentially formed on an outer periphery of the center conductor, and the board comprises a signal electrode connected to the center conductor and a ground electrode connected to the outer conductor comprises:

processing a terminal of the coaxial cable such that the center conductor, the inner insulator and the outer conductor are each exposed;

attaching the exposed inner insulator to a positioning member lying between the signal electrode and the ground electrode;

aligning the exposed center conductor at an arrangement pitch of the signal electrode while the inner insulator is attached to the positioning member; and connecting the center conductor to the signal electrode.

Points Of The Invention

According to one embodiment of the invention, a cable connection structure or cable connection method is constructed or conducted such that (I) a one component moisture-curing elastic adhesive as a positioning member is applied between a signal electrode and a ground electrode on a board using a dispenser, (II) all inner insulators of a multi-core cable are pressed together by a pressure tool to be attached to the one component moisture-curing elastic adhesive, (III) an adjusting needle having a tip diameter smaller than a predetermined arrangement pitch distance between adjacent inner insulators is inserted into a space formed between the adjacent inner insulators of the multi-core cable so as to have temporarily the predetermined arrangement pitch distance therebetween, and (IV) a solder preliminarily applied to a center conductor of the multi-core cable is thermo-compression-bonded using a non-illustrated heating/pressurizing tool to connect the center conductor with the signal electrode. Thus, it is possible to position the micro coaxial cables to the minute pitch electrodes without using a special jig having a comb shape or a groove shape.

BRIEF DESCRIPTION OF THE DRAWINGS

Next, the present invention will be explained in more detail in conjunction with appended drawings, wherein:

FIGS. 3A to 3D are schematic top views showing a procedure of the terminal treatment performed on a multi-core cable in a second embodiment of the invention, wherein FIG. 3A shows an initial process, FIG. 3B shows a process following FIG. 3A, FIG. 3C shows a process following FIG. 3B and FIG. 3D shows a process following FIG. 3C;

FIGS. 4A to 4C are schematic side views showing a procedure for determining a position of the multi-core cable with respect to a board in the second embodiment of the invention, wherein FIG. 4A shows a process following FIG. 2A, FIG. 4B shows a process following FIG. 4A and FIG. 4C shows a process following FIG. 4B;

DETAILED DESCRIPTION OF THE PREFERRED EMBODIMENTS

A preferred embodiment of the invention will be specifically described below in conjunction with the appended drawings.

First Embodiment

Structure of Multi-core Cable

Figure 1:
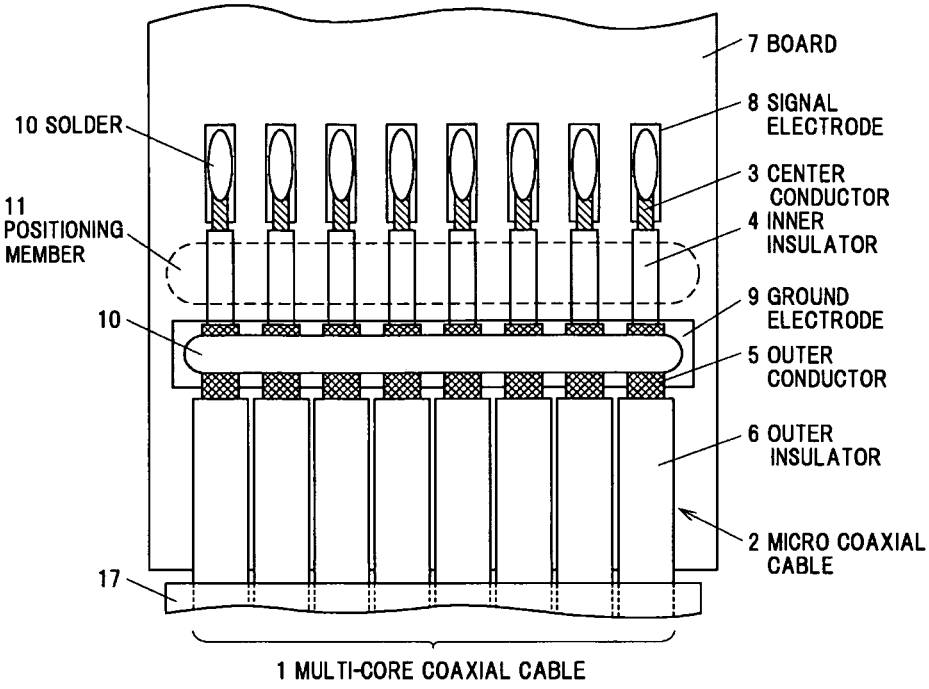
FIG. 1 is a top view schematically showing a cable connection structure in a first preferred embodiment of the present invention.

The reference numeral 1 in FIG. 1 shows the entirety of a multi-core cable which is arranged on a print circuit board 7 (hereinafter referred to as "board 7"). The multi-core cable 1 in the illustrated example is formed by aligning eight micro coaxial cables 2 in parallel at an arrangement pitch distance of 0.15 mm and then integrally coating with an insulation laminated tape 17.

As shown in FIG. 1, each of the eight micro coaxial cables 2 which compose the multi-core cable 1 is integrally formed with a center conductor 3 with an outer diameter of 0.03 mm formed by twisting seven core wires each having a diameter of 0.01 mm, an inner insulator 4 with an outer diameter of 0.06 mm which covers the outer periphery of the center conductor 3, an outer conductor 5 with an outer diameter of 0.1 mm which is a served shield formed of a core wire with an outer diameter of 0.016 mm to cover the outer periphery of the inner insulator 4, and an outer insulator 6 (hereinafter referred to as "jacket 6") with an outer diameter of 0.14 mm which covers the outer conductor 5.

An end portion of the micro coaxial cable 2 has a three-step shape in which the outer conductor 5, the inner insulator 4 and the center conductor 3 are exposed step by step by sequentially scraping from a portion covered by the jacket 6 toward a tip, as shown in FIG. 1. The end portions of the outer conductor 5, the inner insulator 4 and the center conductor 3 are formed by cutting with, e.g., a $CO_2$ laser or a YAG laser.

Electrical Connection of the Multi-core Cable

As shown in FIG. 1, the multi-core cable 1 is attached on the board 7. Signal electrodes 8 and a ground electrode 9 are formed on a surface of the board 7. The signal electrodes 8 are extremely narrow-pitched electrodes formed in an array shape so as to correspond to an arrangement pitch distance (0.15 mm) of the multi-core cable 1. In the illustrated example, a pattern width of the signal electrode 8 is set to about 0.1 mm and a space between adjacent signal electrodes 8 is set to about 0.05 mm.

As shown in FIG. 1, the signal electrode 8 of the board 7 is arranged at a position corresponding to the center conductor 3 of the multi-core cable 1. On the other hand, the ground electrode 9 is formed at a position corresponding to the outer conductor 5 of the multi-core cable 1. Through a solder 10, the signal electrode 8 is electrically connected to the center conductor 3 and the ground electrode 9 is also electrically connected to the outer conductor 5.

Although an example of using the solder 10 for electrical connection between the multi-core cable 1 and the electrodes 8 and 9 of the board 7 is illustrated, it is not limited to the illustrated example. It may be configured to connect using, e.g., an anisotropically conductive material having conductive particles dispersed in a resin or a resin material for maintaining physical contact or physical contact state, etc., instead of using the solder 10 as long as the electrical connection as described above is obtained.

Structure of Positioning Member

The multi-core cable 1 configured as described above and the electrical connection structure of the multi-core cable 1 are not specifically limited. The first embodiment is mainly characterized in that, at the stage of aligning a position of the multi-core cable 1 with respect to the board 7, a positioning member 11 for suppressing misalignment of the center conductors 3 of the multi-core cable 1 during a process of connecting electrodes as a next step is provided. A representative configuration shown in FIG. 1 is that the center conductor 3 of the multi-core cable 1 is positioned and held by the signal electrode 8 in a state that the inner insulator 4 of the multi-core cable 1 is attached, via the positioning member 11, to an intermediate portion formed between the signal electrode 8 and the ground electrode 9 of the board 7.

It is preferable that the positioning member 11 be formed of a nonconductive material having adhesiveness or tackiness. The positioning member 11 can be formed of, e.g., a moisture-curing adhesive, an anaerobic-curing adhesive, a spray type adhesive or a positioning resin such as two-sided adhesive tape, etc. It is preferable to use a one component liquid adhesive when the positioning member 11 is formed by applying an adhesive on the board 7 using a dispenser, however, a multi-component liquid adhesive formed by mixing plural liquids may be used. Note that, it is desirable that the positioning member 11 be located middle between the signal electrode 8 and the ground electrode 9 in order to prevent contact failure caused by seepage to a portion related to the electrical connection, such as the signal electrode 8 and the ground electrode 9.

Peeling Strength of the Positioning Member It is desirable that the positioning member 11 have a peeling strength of 1 to 50 N/20 mm at the stage before curing. It is not possible to position and hold the inner insulator 4 of the multi-core cable 1 at a predetermined position when the peeling strength is low. A one component moisture-curing adhesive has a peeling strength of 2 N/20 mm at the stage before curing. Alternatively, e.g., a synthetic rubber-based adhesive having a peeling strength of 4 N/20 mm or a two-sided adhesive tape with a peeling strength of 30 N/20 mm may be used. The peeling strength is derived according to JIS Z 0237 and a 90° peel test is conducted under the test conditions of a testing speed of 300 min/min using polyimide as a test specimen.

Among various multi-core cables 1, in a case of using a micro coaxial cable with the maximum outer diameter in which the inner insulator 4 has a diameter of 0.12 mm, the inner insulator 4 can be fixed by a synthetic rubber-based adhesive material having a peeling strength of 1 N/20 mm but is not fixed sufficiently by a slightly adhesive film having a peeling strength of 0.7 N/20 mm. Therefore, the lower limit of the peeling strength of the positioning member 11 is desirably about 1 N/20 mm.

On the other hand, when the peeling strength of the positioning member 11 is more than 50 N/20 mm, a tip of an adjusting needle for moving the position of the inner insulator 4 is bent and it becomes difficult to properly adjust the position of the inner insulator 4. Therefore, the upper limit of the peeling strength of the positioning member 11 is desirably about 50 N/20 mm.

Thickness of the Positioning Member

The thickness of the positioning member 11 is desirably set to be thin in order to suppress to the minimum the misalignment of the micro coaxial cable 2 at the time of pressurization during the process of connecting electrodes. However, a desired peeling strength is not obtained in many cases when the positioning member 11 is thin. Therefore, a thickness of at least 10 μm or more is required for the positioning member 11.

The optimum value of the amount applied to the board 7 varies depending on a material constituting the positioning member 11. For a resin material in an irregular shape, it is preferable to apply a resin in an amount that an excess resin material does not seep to the signal electrode 8 or the ground electrode 9 of the board 7 even when the inner insulator 4 is pressed and embedded into the resin material. It is desirable that the positioning member 11 have a thickness of about 10 to 100 μm. It is preferable to set the positioning member 11 to have a thickness of about 100 μm in order to attach the inner insulator 4 having the outer diameter of 0.06 mm of the multi-core cable 1 in the first embodiment to the board 7.

When the positioning member 11 is set to be thick, a fixed position between the center conductor 3 of the multi-core cable 1 and the signal electrode 8 of the board 7 is separated vertically by the thickness of the positioning member 11. Ideally and desirably, the center conductor 3 is in contact with the signal electrode 8 at the stage of soldering and connecting the center conductor 3 by pressuring using a pressurizing/heating tool.

However, when the position of the multi-core cable 1 is determined in a state that the center conductor 3 and the signal electrode 8 are separated vertically for convenience of alignment and the distance between the center conductor 3 and the signal electrode 8 becomes 100 μm or more, the center conductor 3 may be misaligned at least about 50 μm in a lateral direction from the predetermined fixed position when the center conductor 3 is pressed by the pressurizing/heating tool.

Meanwhile, even if the center position of the center conductor 3 coincides with the center position of the signal electrode 8 at the stage of aligning the position of the center conductor 3 of the multi-core cable 1 to the board 7 having the signal electrode 8 of which electrode pattern width is 100 μM, contact failure occurs when the center position of the center conductor 3 is misaligned 50 μm or more from the center position of the signal electrode 8 at the time of pressing the center conductor 3 by the pressurizing/heating tool.

Therefore, the thickness of the positioning member 11 is desirably no more than 100 μm in order to align the position in a state that a space (gap) in a vertical direction between the center conductor 3 of the multi-core cable 1 and the signal electrode 8 of the board 7 is 100 μm or less.

When a two-sided adhesive tape is used as the positioning member 11, it is necessary to narrow the gap in a vertical direction between the inner insulator 4 of the multi-core cable 1 and the board 7 as much as possible to obtain sufficient strength by the two-sided adhesive tape since the two-sided adhesive tape has an irregular shape. Accordingly, a preferable thickness of the two-sided adhesive tape is at least about 10 μm. The amount of the positioning member 11 attached to the inner insulator 4 correlates with a peeling strength, and in view of positioning workability, it is desirable that the inner insulator 4 be attached so as to be embedded no more than half (embedded about one-third) in an outer diameter direction thereof.

Effects of the First Embodiment

The following effects are obtained by the cable connection structure of the first embodiment described above.

(1) It is possible to effectively use the cable connection structure as an extremely narrow pitch connection structure of a multi-core micro coaxial cable to various boards with a flat electrode.

(2) It is possible to easily and surely position micro coaxial cables with respect to minute pitch electrodes.

(3) Since it is a cable connection structure not using a commonly-used connector, it is possible to minimize the mounting area on the board.

Second Embodiment

A specific embodiment of a cable connection method for obtaining the cable connection structure in the first embodiment will be described in detail below in reference to FIGS. 2 to 6. It should be noted that a typical example of the first embodiment is given in the second embodiment and it is obvious that the invention is not limited to the illustrated example.

Terminal Treatment of Multi-core Cable

Figure 2:
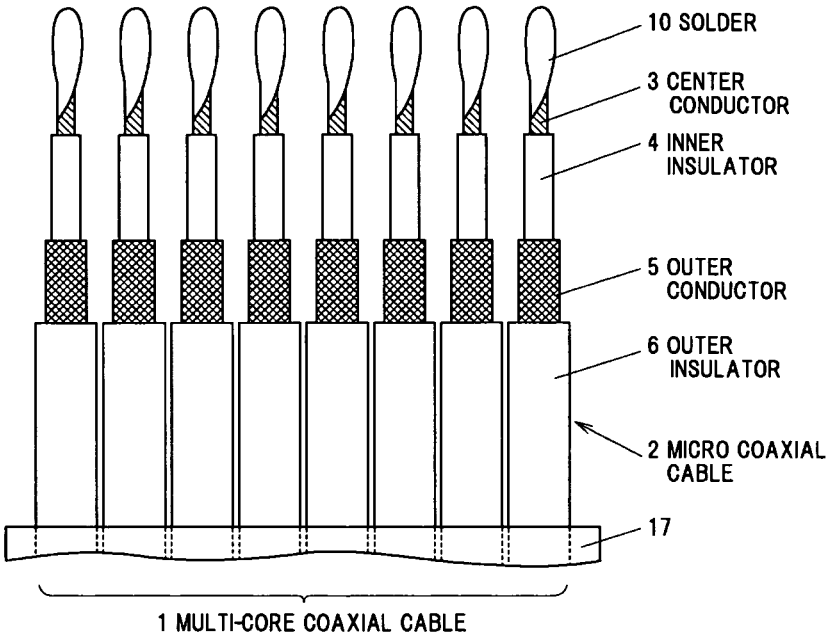
FIG. 2 is a schematic top view showing a multi-core cable on which terminal treatment is performed.

Before the eight micro coaxial cables 2 integrated by the laminated tape 17 is electrically connected to the signal electrode 8 and the ground electrode 9 of the board 7, the terminal treatment of the multi-core cable 1 using a $CO_2$ laser or a YAG laser is each performed in the terminal treatment processes, which are a jacket cutting process, an outer conductor cutting process and an inner insulator cutting process. In a preferred form, the end portion of the multi-core cable 1 which is shown in FIG. 2 is effectively obtained through the terminal treatment processes shown in FIG. 3.

Jacket Cutting Process

Figure 3A:
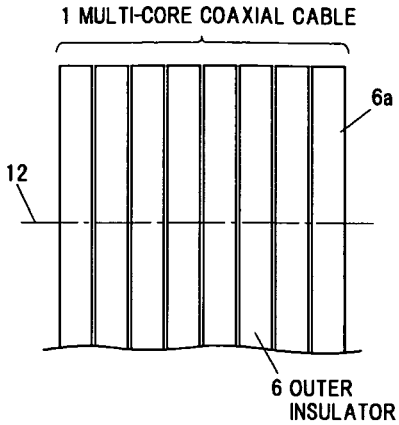

In the procedure for the terminal treatment of the multi-core cable 1, firstly, the jacket 6 is cut by irradiating a $CO_2$ laser on the front and back sides at each cutting position 12 having a desired length from the end portion of the multi-core cable 1 in the jacket cutting process shown in FIG. 3A, thereby forming a cut jacket 6*a*. Next, the cut jacket 6*a* is pulled out from the cutting position 12 toward the tip side of the cable, thereby exposing the outer conductor 5. Then, it proceeds to the outer conductor cutting process shown in FIG. 3B.

Outer Conductor Cutting Process

Figure 3B:
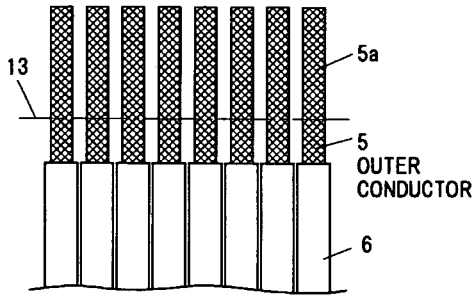

In the outer conductor cutting process shown in FIG. 3B, the outer conductor 5 is cut by irradiating a YAG laser on the front and back sides at each cutting position 13 having a desired length from the end portion of the multi-core cable 1. Next, a cut outer conductor 5*a* is pulled out from the cutting position 13 toward the tip side of the cable, thereby exposing the inner insulator 4. Then, it proceeds to the inner insulator cutting process shown in FIG. 3C.

Inner Insulator Cutting Process

Figure 3C:
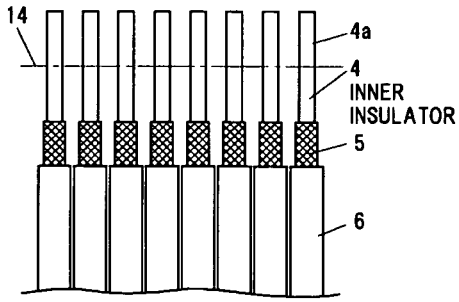
Figure 3D:
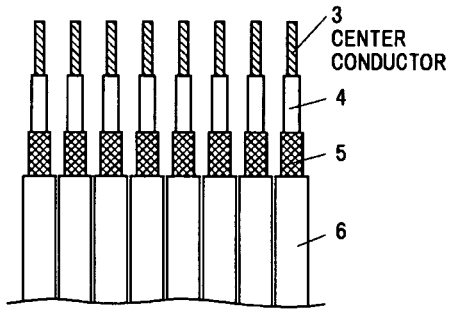

In the inner insulator cutting process shown in FIG. 3C, the inner insulator 4 is cut by irradiating a $CO_2$ laser on the front and back sides at each cutting position 14 having a desired length from the end portion of the multi-core cable 1. Next, a cut inner insulator 4*a* is pulled out from the cutting position 14 toward the tip side of the cable, thereby exposing the center conductor 3. This state is shown in FIG. 3D. Then, as the final process, the solder 10 is applied to the end portion of the center conductor 3 by dipping the exposed end portion of the center conductor 3 into a molten solder bath (not shown).

The end portion of the multi-core cable shown in FIG. 2 is obtained by the terminal treatment described above. In the second embodiment, the exposed length of the outer conductor 5 of the micro coaxial cable 2 is formed to be 0.4 mm, the exposed length of the inner insulator 4 is formed to be 1.4 mm and the exposed length of the center conductor 3 is formed to be 1.9 mm. The solder 10 formed of Sn—3.0% Ag—0.5% Cu is applied to the end portion of the center conductor 3.

Terminal Connection Method of Multi-core Cable

In the meantime, at the stage that the terminal treatment of the multi-core cable 1 is completed, the micro coaxial cable 2 still maintains linearity of the cable but is extremely flexible and has a very thin shape. Therefore, the arrangement pitch distance becomes slightly but still irregular at the end portion of the cable. The irregularity of the arrangement pitch distance does not arise such that adjacent center conductors 3 contact each other but may cause a state that the arrangement pitch distance is reduced to about half of the initial setting of the pitch distance. There may be a case that the adjacent center conductors 3 are separated away in an opposite manner.

Figure 5A:
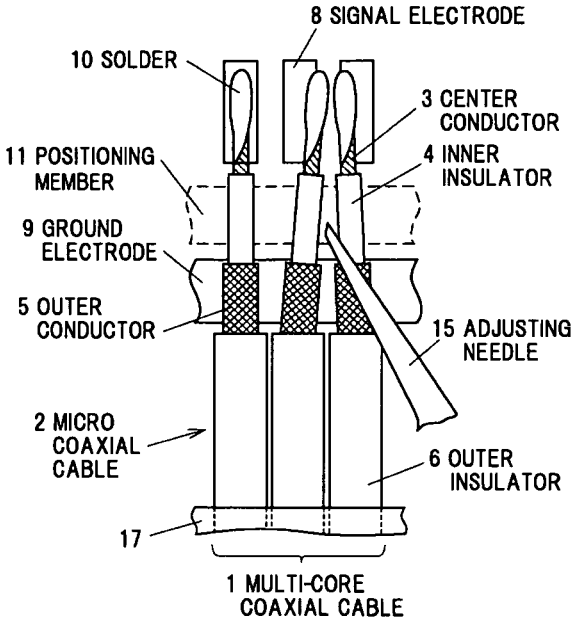
FIGS. 5A and 5B are plan views schematically showing a conductor positioning process of FIG. 4C.
Figure 5B:
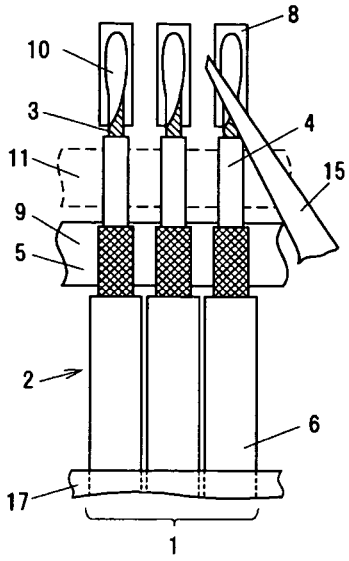
Figure 6:
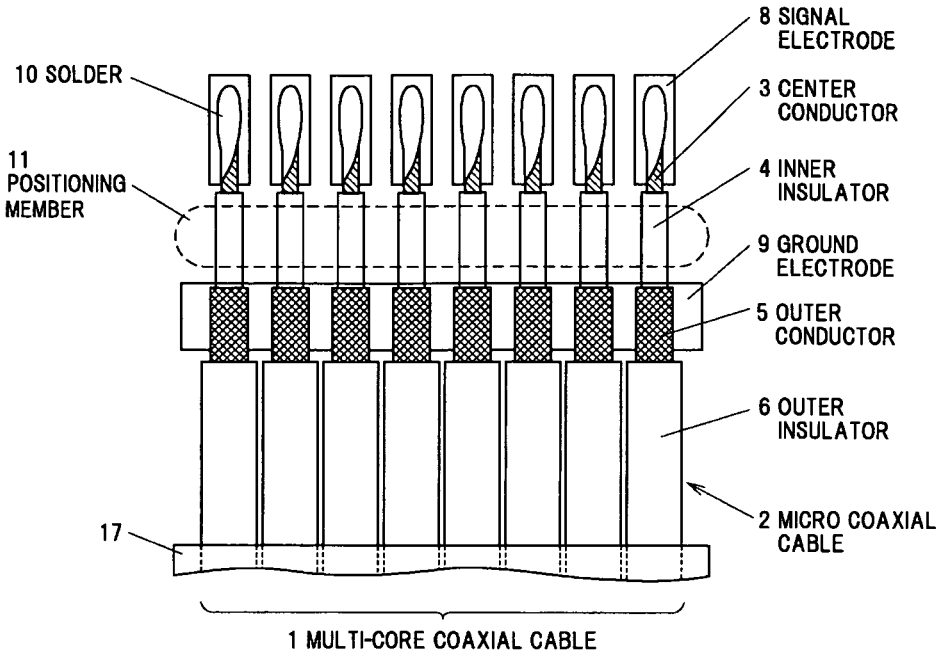
FIG. 6 is a top view schematically showing a state that the multi-core cable is positioned on electrodes.

The main configuration in the second embodiment is achieved by the terminal connection method of the multi-core cable 1 in which the multi-core cable 1 is arranged on the surface of the board 7 and is then pressed, and at the same time as pressing, the inner insulator 4 of the multi-core cable 1 is attached, positioned and fixed to the board 7 in order to electrically connect the end portion of the multi-core cable 1 to the signal electrode 8 and the ground electrode 9 of the board 7. In the preferred form, the cable connection structure shown in FIG. 1 can be effectively obtained by the cable connection method including a process of attaching the micro coaxial cable 2, a process of aligning the micro coaxial cable 2 and a process of connecting the micro coaxial cable 2 to an electrode as shown in FIGS. 4 to 6.

Process of Attaching Micro Coaxial Cable

Figure 4A:
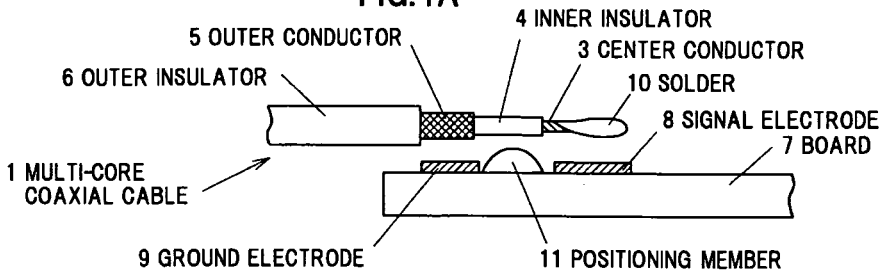
Figure 4B:
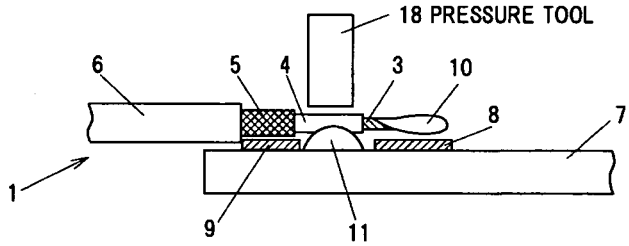

FIG. 4 shows an attachment process when aligning the position of the multi-core cable 1 with respect to the signal electrode 8 and the ground electrode 9 of the board 7. Regarding the processes of attaching the micro coaxial cable 2 showing FIGS. 4A and 4B, firstly, a one component moisture-curing elastic adhesive as the positioning member 11 is applied between the signal electrode 8 and the ground electrode 9 of the board 7 using a dispenser in the first attachment process shown in FIG. 4A. A position of the multi-core cable 1 in an axial direction and positions of the micro coaxial cables 2 arranged on both outermost sides are aligned with respect to the signal electrodes 8. At this time, the multi-core cable 1 is not arranged at a position which completely coincides with the signal electrode 8.

Subsequently, all inner insulators 4 of the multi-core cable 1 are pressed together by a pressure tool 18 and are attached to the one component moisture-curing elastic adhesive in the second attachment process shown in FIG. 4B. The entire multi-core cable 1 is brought in contact with the surface of the board 7 at the same time as pressing the inner insulators 4. The multi-core cable 1 is still not arranged at a position which completely coincides with the signal electrode 8 at this time, however, the multi-core cable 1 is not easily moved since the inner insulators 4 are attached to the one component moisture-curing elastic adhesive.

Process of Aligning the Micro Coaxial Cable

Figure 4C:
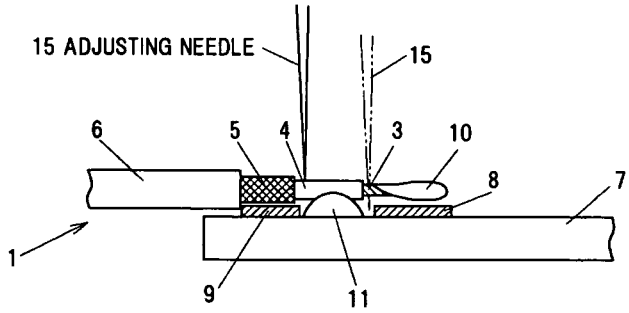

Next, in the process of aligning the micro coaxial cable 2 shown in FIG. 4C, an adjusting needle 15 having a tip diameter smaller than the arrangement pitch distance supposed to be between adjacent inner insulators 4 is inserted into a space (arrangement pitch distance) formed between the adjacent inner insulators 4 of the multi-core cable 1. The arrangement pitch distance of the inner insulator 4 is equalized by moving the adjusting needle 15 along an axial direction of the multi-core cable 1. In the illustrated example, the arrangement pitch distance between the adjacent inner insulators 4 is set to 0.09 mm, and thus, the adjusting needle 15 having a diameter of 0.2 mm and a tip diameter of 0.05 mm is used.

At this time, the inner insulator 4 of the multi-core cable 1 is attached to the one component moisture-curing elastic adhesive but is not completely fixed. As shown in FIGS. 5A and 5B, the multi-core cable 1 is moved in accordance with the movement of the adjusting needle 15 so as to equalize the arrangement pitch distance and is temporarily fixed at a predetermined position. All arrangement pitch distances of the micro coaxial cables 2 coincide with the arrangement pitch distances of the signal electrodes 8 by inserting the adjusting needle 15 into the required spaces between the inner insulators 4. Then, it proceeds to the final process, which is a process of connecting the micro coaxial cable 2 to an electrode.

Process of Connecting the Micro Coaxial Cable to Electrode

In the process of connecting the micro coaxial cable 2 to an electrode shown in FIG. 6, the solder 10 preliminarily applied to the center conductor 3 of the multi-core cable 1 is thermo-compression-bonded using a non-illustrated heating/pressurizing tool. In the illustrated example, the solder 10 applied to the center conductor 3 is molten by heating and pressurizing under the conditions of a pressure of 2 MPa, a heating temperature of 280° C. and treatment time of 30 seconds, and all center conductors 3 are connected to the signal electrodes 8 of the board 7 at a time.

Following this, a paste solder (not shown) is applied to the surface of the outer conductor 5 of the multi-core cable 1 using a dispenser and is thermo-compression-bonded using a heating/pressurizing tool which is not illustrated, neither. The paste solder applied to the outer conductor 5 is molten by heating and pressurizing under the conditions of a pressure of 0.5 MPa, a heating temperature of 280° C. and treatment time of 30 seconds, and all outer conductors 5 are connected to the ground electrode 9 of the board 7 at a time. The cable connecting process is completed by the above operations.

Modifications

Although the solder 10 preliminarily applied is used to connect the center conductor 3 of the multi-core cable 1 in the second embodiment, an anisotropically conductive material may be preliminarily provided on the signal electrode 8 of the board 7 so that the center conductor 3 is connected to the signal electrode 8 by pressurizing and heating instead of provided the solder 10 on the center conductor 3, or a solder paste may be applied and then molten by pressurizing and heating in order to carry out the connection.

Although the solder paste applied on the surface of the outer conductor 5 of the multi-core cable 1 is molten by pressurizing and heating to connect the outer conductor 5 to the ground electrode 9 in the second embodiment, an anisotropically conductive material may be alternatively used for the connection, or the connection by pressure and heat may be carried out after providing a sheet-shaped or wire-shaped solder on the outer conductor 5.

Although the one component moisture-curing elastic adhesive as a material which solidifies over time is used as the positioning member 11 in the second embodiment, any materials which exhibit an adhesive effect during the cable connection work may be alternatively used, and a material used may lose the adhesive effect due to solidification after completion of the cable connecting process or due to change of properties.

Effects of the Second Embodiment

The following effects are obtained by the cable connection method of the second embodiment described above.

(1) It is possible to position the micro coaxial cables to the minute pitch electrodes without using a special jig having a comb shape or a groove shape.

(2) Since the micro coaxial cable is temporarily fixed and is then electrically connected, it is possible to select a method of contact resistance such as an anisotropically conductive material or solder.

(3) Since a material which is cured over time or is cured by applying external energy such as heat is used as an adhesive material, it is possible to contribute to improvement in connection strength.

Third Embodiment

As obvious from the above explanation, the cable connection structure and the cable connection method of the invention have been described based on each of the embodiments, however, the invention is not limited to each of the embodiments, the modification and the illustrated examples, and can be implemented in various modes without departing from the gist thereof. Another embodiment, e.g., shown below, is applicable in the invention.

The first and second embodiments are configured such that the position of the center conductor 3 of the multi-core cable 1 is adjusted without using a positioning jig, however, the position of the center conductor 3 is adjusted using a positioning jig in the third embodiment. Note that, members substantially the same as those in each of the embodiments are denoted by the same names and reference numerals. Therefore, the detailed description for the members substantially the same as those in each of the embodiments will be omitted.

Figure 7A:
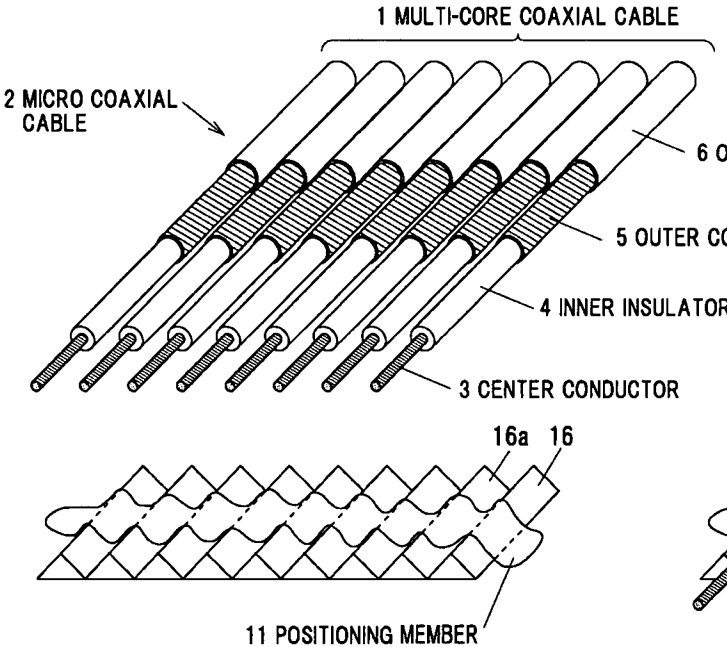
FIGS. 7A and 7B are schematic perspective views for explaining positioning of a cable with respect to a groove-shaped jig in a third embodiment of the invention.
Figure 7B:
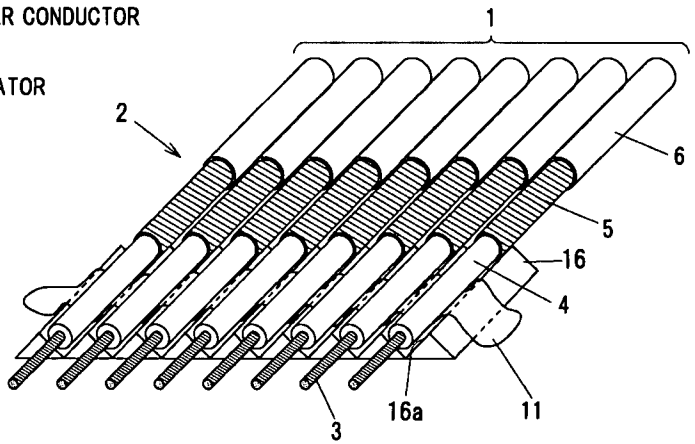

FIGS. 7A and 7B show an example in which the positioning member 11 for fixing the inner insulator 4 of the micro coaxial cable 2 is applied on a surface of a groove-shaped jig 16 which has a groove 16*a*. The groove-shaped jig 16 in the illustrated example forms a part of the positioning member. The groove-shaped jig 16 is a 0.125 mm-thick polyimide sheet on which the groove 16*a* is shaped by cutting to a cut depth of 0.1 mm at a pitch equal to a cable arrangement pitch distance, and the groove 16*a* has a wavy V-shape.

As in the positioning member 11 shown in FIG. 1, the groove-shaped jig 16 is arranged between signal electrode 8 and the ground electrode 9 of the board 7. A synthetic rubber-based adhesive material to be the positioning member 11 is sprayed and applied to the groove 16*a* of the groove-shaped jig 16. The multi-core cable 1 after the terminal treatment is arranged on the board 7 and the inner insulator 4 of the micro coaxial cable 2 is pressed into the positioning member 11. The multi-core cable 1 is fitted in the groove 16*a* of the groove-shaped jig 16 as shown in FIG. 7B and is temporarily fixed by the positioning member 11 which is applied on the surface of the groove-shaped jig 16.

Effects of the Third Embodiment

Although almost the same procedure as that shown in FIG. 4 is employed also in the cable connection method of the third embodiment, positional adjustment of the center conductor 3 of the multi-core cable 1 using the micro-adjusting needle 15 is not required, unlike the processes shown in FIGS. 4C to 5B. According to the third embodiment, it is possible to carry out fine adjustment of the position of the center conductor 3 and at the same time to temporarily fix the center conductor 3 by pressing the inner insulator 4 of the multi-core cable 1 against the positioning member 11.

The inner insulator 4 of the multi-core cable 1 can be inserted into a groove of a conventional groove-shaped jig without applying the positioning member 11 on the surface thereof. However, there is a problem that some of the center conductors 3 climb over a side surface forming the groove without being positioned and fixed to a groove bottom of the groove-shaped jig due to slight bending caused by flexibility or a very thin shape of the micro coaxial cable 2 and it is not possible to properly align the position.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A cable connection method for connecting a multi-core coaxial cable to a board, wherein the multi-core coaxial cable comprises a plurality of parallel-arranged coaxial cables each comprising a center conductor and an inner insulator, an outer conductor and an outer insulator sequentially formed on an outer periphery of the center conductor, and the board comprises a signal electrode connected to the center conductor by heating and pressurizing and a ground electrode connected to the outer conductor by heating and pressurizing, the method comprising:

processing a terminal of the coaxial cable such that the center conductor, the inner insulator, and the outer conductor are each exposed;

attaching the exposed inner insulator to a positioning member lying between the signal electrode and the ground electrode such that a tip portion of the exposed center conductor is free from being attached to the positioning member, the positioning member comprising a thickness in a range from 10 μm to 100 μm, the coaxial cables being cantilevered from an edge of the positioning member;

aligning the exposed center conductor at an arrangement pitch of the signal electrode while the inner insulator is attached to the positioning member; and connecting the center conductor to the signal electrode, wherein an entirety of the positioning member is located below the exposed inner insulator.

2. The method according to claim 1, wherein an upper limit of the thickness of the positioning member is set based on a misalignment of at least 50 μm of the center conductor in a lateral direction from a predetermined fixed position when the center conductor is pressed by a pressurizing/heating tool.

3. The method according to claim 1, further comprising:

applying a pressurizing/heating tool to dispose a solder, by heating and pressing, on at least one of the center conductor and the outer conductor.

4. The method according to claim 1, further comprising:

applying a solder to the center conductor and/or the outer conductor, wherein the heating and pressurizing comprises locally heating and pressurizing the solder applied to the center conductor and/or the outer conductor with a pressurizing/heating tool.

5. The method according to claim 1, wherein, during said attaching the exposed inner insulator to the positioning member, the coaxial cables are cantilevered from the edge of the positioning member.

6. The method according to claim 1, wherein only the exposed inner insulator is attached to the positioning member.

7. The method according to claim 1, wherein the exposed center conductor is not attached to the positioning member.

8. The method according to claim 1, wherein, after said attaching the exposed inner insulator to the positioning member, an entire portion of the exposed center conductor is freely movable.

9. The method according to claim 1, wherein, after said attaching the exposed inner insulator to the positioning member, the tip portion of the exposed center conductor is freely movable.

10. The method according to claim 1, wherein said aligning the exposed center conductor comprises inserting an adjusting needle into a space between the inner insulator and an adjacent inner insulator of the coaxial cables.

11. The method according to claim 10, further comprising moving the adjusting needle long an axial direction of the multi-core coaxial cable to adjust an arrangement pitch distance of the inner insulator.

12. The method according to claim 10, wherein, in said attaching the exposed inner insulator to the positioning member, the inner insulator and the adjacent inner insulator are pressed together to attach to the positioning member.

13. The method according to claim 1, further comprising applying a solder to the surface of the outer conductor to connect the outer conductor to the ground electrode.

* * * * *